US005960648A

United States Patent [19]

Straemke

[11] Patent Number: 5,960,648

[45] Date of Patent: Oct. 5, 1999

[54] PROCESS AND DEVICE FOR THE TREATMENT OF FIBROUS MATERIAL

[76] Inventor: Siegfried Straemke, Fichtenhain 6, 52536 Selfkant, Germany

[21] Appl. No.: 08/917,931

[22] Filed: Aug. 27, 1997

[30] Foreign Application Priority Data

Aug. 28, 1996 [DE] Germany ..... 196 34 725

[51] Int. Cl.[6] ..... B08B 3/12

[52] U.S. Cl. ..... 68/5 D; 68/19.1; 68/5 R; 8/151

[58] Field of Search ..... 68/19.1, 12.3, 68/5 E, 5 R, 5 D; 8/156, 149.3, 151

[56] References Cited

U.S. PATENT DOCUMENTS 3,808,846 5/1974 Fleissner ..... 68/19.1
3,922,738 12/1975 Holm ..... 8/151
3,981,162 9/1976 Klier ..... 68/184
4,065,137 12/1977 Rueggeberg et al. ..... 277/34
4,507,539 3/1985 Sando et al. ..... 219/121 PY
4,775,383 10/1988 Sugimoto et al. ..... 8/115.54

*Primary Examiner*—Jill Warden
*Assistant Examiner*—Paul J. Lee
*Attorney, Agent, or Firm*—Diller, Ramik & Wight, PC

[57] ABSTRACT

The invention refers to a process and a device for the treatment of fibrous material. In order to provide a process for the treatment of fibrous material which allows for cleaning and preparing fibrous material, the invention provides that fibrous material, especially combed sliver, textiles, non-woven fabrics and wool fiber bunches, are at first cleaned in a cleaning phase with support from a solvent, then dried in a vacuum drying phase, and then surface modified in a plasma treatment phase. The device (100,200) proposed according to the invention for the treatment of fibrous material comprises a cleaning vessel (102,202), a vacuum drier (104,204) and a plasma treatment vessel (106,206) for this purpose.

11 Claims, 2 Drawing Sheets

PROCESS AND DEVICE FOR THE TREATMENT OF FIBROUS MATERIAL

BACKGROUND OF THE INVENTION

The present invention refers to a process and a device for the treatment of fibrous material.

Natural and artificial fibers are used in a lot of industrial applications. In order to be able to use the natural and artificial fibers, a preparatory treatment is often required. Natural fibers, on the one hand, can be provided in a soiled form as a combed sliver, for example, so that it is necessary to clean and treat them prior to processing. Fibrous material consisting of artificial fibers, on the other hand, is in most cases provided without impurities, but, for a lot of processing methods, surface modifications of the fibrous material are required. If, for example, the artificial fiber material is to be embedded in a plastic mass, a depassivation of the surface of the fibrous material is required for a good adhesion between the fibrous material and the plastic mass enclosing the fibrous material.

In practice, methods for processing fibrous material have been known in which various cleaning and etching methods with baths and steam atmospheres have been used to clean and treat the fibrous material. In order to process the fibrous material treated in such baths or atmospheres, the cleaned and/or etched fibrous material is dried. However, the cleaning and etching baths produce a lot of waste to be disposed. There also is the danger of chemicals being released into the environment from the fibrous material because of the fibrous material being insufficiently dried.

SUMMARY OF THE INVENTION

The present invention is based on the objective to provide a process and a device for the treatment of fibrous material allowing for cleaning and treating fibrous material without harming the environment.

According to the invention, the fibrous material is surface modified in a plasma treatment phase in a plasma treatment vessel. This surface modification in a plasma renders chemical etching baths superfluous. There is no danger of chemicals being released into the environment via the fibrous material, as the plasma treatment phase takes place in a high vacuum. Even volatile particles or loose particles adhering to the fibrous material, from a previous cleaning operation or any other chemical treatment, are removed in the plasma treatment phase and remain within the treatment device.

The plasma treatment process is supported by the fibrous material at first being cleaned in a cleaning phase with support from a solvent and then being dried in a vacuum drying phase. The cleaning phase with support from a solvent, in which water, hydrocarbons or halogenated hydrocarbons, especially benzine and per, can be used as a solvent, especially separates solid impurities from the fibrous material. Because of the cleaning phase with support from the solvent, only small amounts of impurities to be removed in the plasma treatment process adhere to the fibrous material.

In the vacuum drying phase, volatile or fluid substances are withdrawn from the fibrous material, so that a superfine vacuum can be maintained during the subsequent plasma treatment phase. Thereby, according to the process of the invention, and especially in a device according to the invention, fibrous material can be treated very effectively and with high quality. The treated fibrous materials of natural or artificial fibers comprise optimum properties for subsequent treatment processes such as embedding these materials in plastics or spinning them.

Preferably, the fibrous material cleaned in the cleaning phase is supplied, immediately and excluding ambient influences, to the vacuum drying phase. Thereby, the danger of newly soiling the fibrous material is eliminated. When the fibrous material dried in the vacuum drying phase is supplied, immediately and excluding ambient influences, in a vacuum atmosphere to the plasma treatment phase, a danger of soiling is averted even between these steps in the process. Furthermore, energy is saved in such a process management, as it is not necessary to change the pressure in the fibrous material to the level necessary for vacuum processes.

In order to recover fluids used to treat the fibrous material in the cleaning phase, the steam portions contained in the stream of gas exhausted in the vacuum drying phase are separated. Preferably, the process management is such that the exhausted steam portions are fractioned so that a highly pure cleaning agent is provided.

The highly pure cleaning agent should at first only be used in a final cleaning step in the cleaning phase, the cleaning agent then being led in the counterflow to the fibrous material to be cleaned. Thereby, it is ensured that the fibrous material is finally treated with a cleaning agent having the highest purity possible.

The process for treating fibrous material can be put into practice advantageously in an especially formed device in which a cleaning vessel, a vacuum drier and a plasma treatment vessel are interconnected via pressure resistant conduits. Preferably, such a device comprises guiding means and material locks so that fibrous material in the shape of strands, especially combed sliver of sheep wool or artificial fiber strands, can be treated. In order to produce the vacuum in the vacuum drier and in the plasma treatment vessel, there preferably is provided a shared vacuum pump, thus limiting the amount of equipment required for the device.

BRIEF DESCRIPTION OF THE DRAWINGS

Further advantageous embodiments and improvements of the invention are illustrated in the dependent claims as well as in the drawings in connection with the description.

There now follows a more detailed description of the invention by means of preferred embodiments.

DESCRIPTION OF THE PREFERRED EMBODIMENTS

Figure 1:
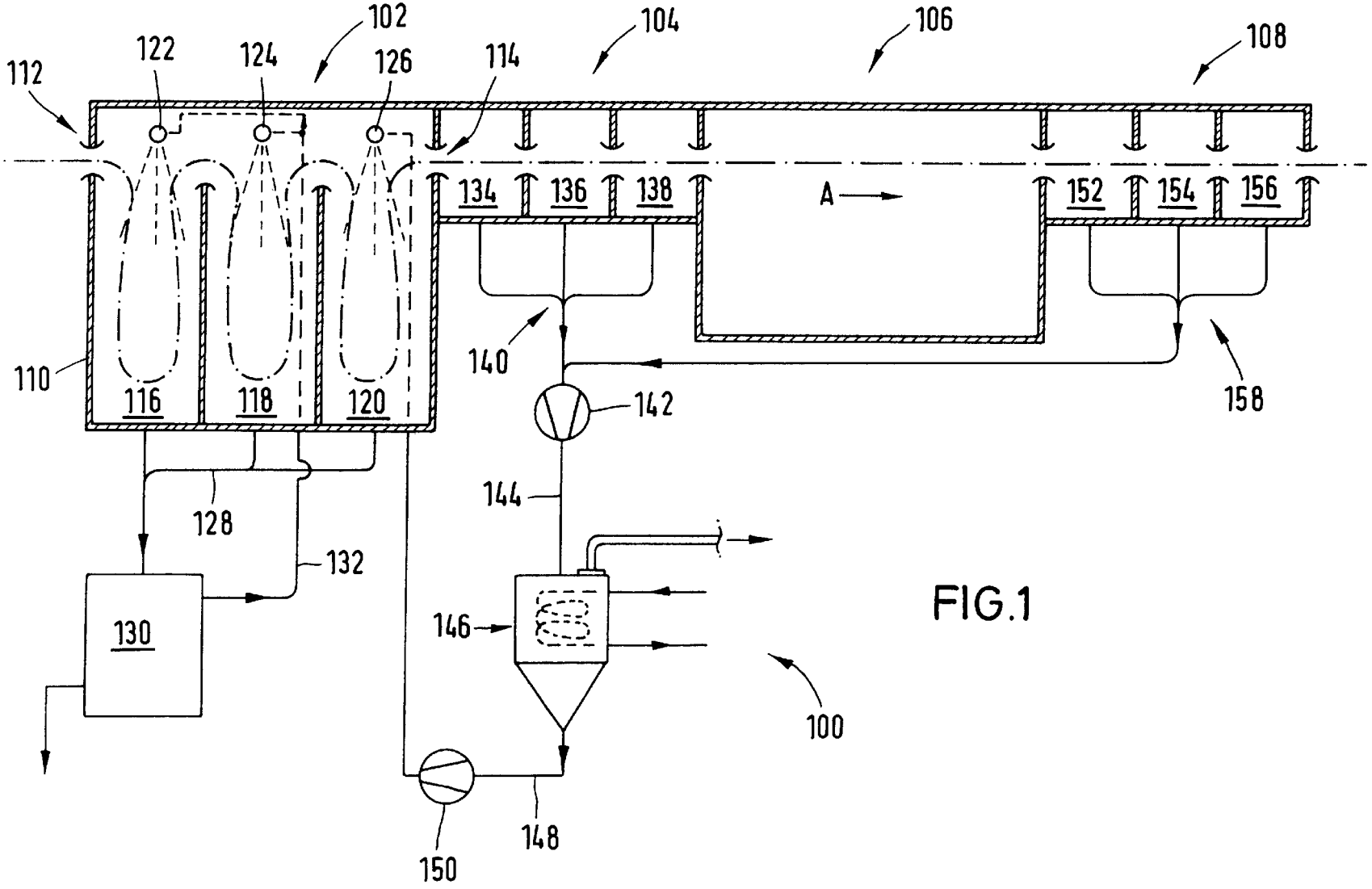
FIG. 1 shows a first embodiment of a device for the treatment of fibrous material.

The device for the treatment of fibrous material 100 shown in FIG. 1 comprises a cleaning vessel or chamber 102, a vacuum drier chamber 104 downstream of the cleaning vessel, and a plasma treatment vessel or chamber 106 downstream of the vacuum drier chamber 104, the plasma treatment vessel having a material outlet lock 108. The cleaning vessel 102, the vacuum drier chamber 104, the plasma treatment vessel 106 and the material outlet lock 108 are provided with material outlet locks (not shown) such that a fibrous material in the shape of strands can be continuously transported therethrough along the treatment path shown in dot-dash line in the direction of arrow A.

The cleaning vessel 102 comprises a closed housing 110, a first material lock 112 being provided at an inlet side and a second material lock 114 being provided at an outlet side thereof. The material locks are designed such that the fibrous material can be guided into and out of the cleaning vessel 102 without obstruction, with ambient air, however, being excluded to a far extent. Furthermore, the cleaning vessel 102 comprises three immersion basins 116,118,120 which can in part be filled with a cleaning agent so that the fibrous material can be immersed into them. Spillways can be provided between the individual immersion basins 116,118, 120 so that the cleaning agent flows from the last immersion basin 120 via the intermediate immersion basin 118 to the first immersion basin 116 in the counterflow to the fibrous material in the manner of a cascade. Apart from that, nozzles 122,124,126 are provided in the cleaning vessel 102 which nozzles discharge a cleaning agent or a mixture of cleaning agent and air to spray the fibrous material. The cleaning agent used in the cleaning vessel 102 is supplied, via drain pipes 128, to a cleaning agent treatment device 130 in which impurities are separated from the cleaning agent. A cleaning agent conduit 132 leads from the cleaning agent treatment device 130 to the nozzles 122,124, which are arranged in the area of the first and second immersion basins 116,118, where they perform a preliminary and an intermediate cleaning operation.

The cleaning vessel 102 is connected directly to the vacuum drier chamber 104 comprising a first vacuum chamber 134, a second vacuum chamber 136 and a third vacuum chamber 138. The vacuum chambers 134,136,138 are connected to a vacuum pump 142 via suction conduits 140. A steam conduit 144 runs from the vacuum pump 142 to a condenser 136 provided as a stripping column. In this condenser 146, highly pure cleaning agent is separated, which is transported by a pump 150 arranged in a supply conduit 148 to the nozzles 126 arranged in the cleaning vessel 102 in the area of the third immersion basin 120. These nozzles 126 are used to perform a final cleaning operation. The suction conduits leading towards the vacuum pump 142 are dimensioned and/or provided with adjusting valves such that an increasingly strong vacuum can be produced in the vacuum chambers 134,136,138.

The plasma treatment vessel 106 is arranged immediately downstream of the vacuum drier 104 in the transporting direction (arrow A) of the fibrous material. Said vessel does not comprise a suction source of its own and is evacuated via the vacuum drier 104. The electrodes required for the production of a plasma in the plasma treatment vessel 106 as well as any inert and/or reaction gas connections are not shown.

The fibrous material treated in the plasma treatment vessel 106 can be discharged continuously via the material outlet lock 108 comprising a first outlet chamber 152, a second outlet chamber 154 and a third outlet chamber 156 and be supplied to a spinning or knitting machine for further processing, for example, or to an embedding process. However, instead of the material outlet lock 108, there can also be provided a material vessel where the fibrous material is at first supplied for intermediate storage, especially in order to be reeled. When such a material vessel is full, it can be replaced by a new material vessel. In order to keep the amount of equipment required at a low level, the material outlet chambers 152,154,156 are connected to the vacuum pump 142 via suction conduits 158. The pressure level in the material outlet chambers 152,154,156 is set such that any penetration of ambient air into the plasma treatment vessel 106 through the material outlet lock 108 is avoided.

Figure 2:
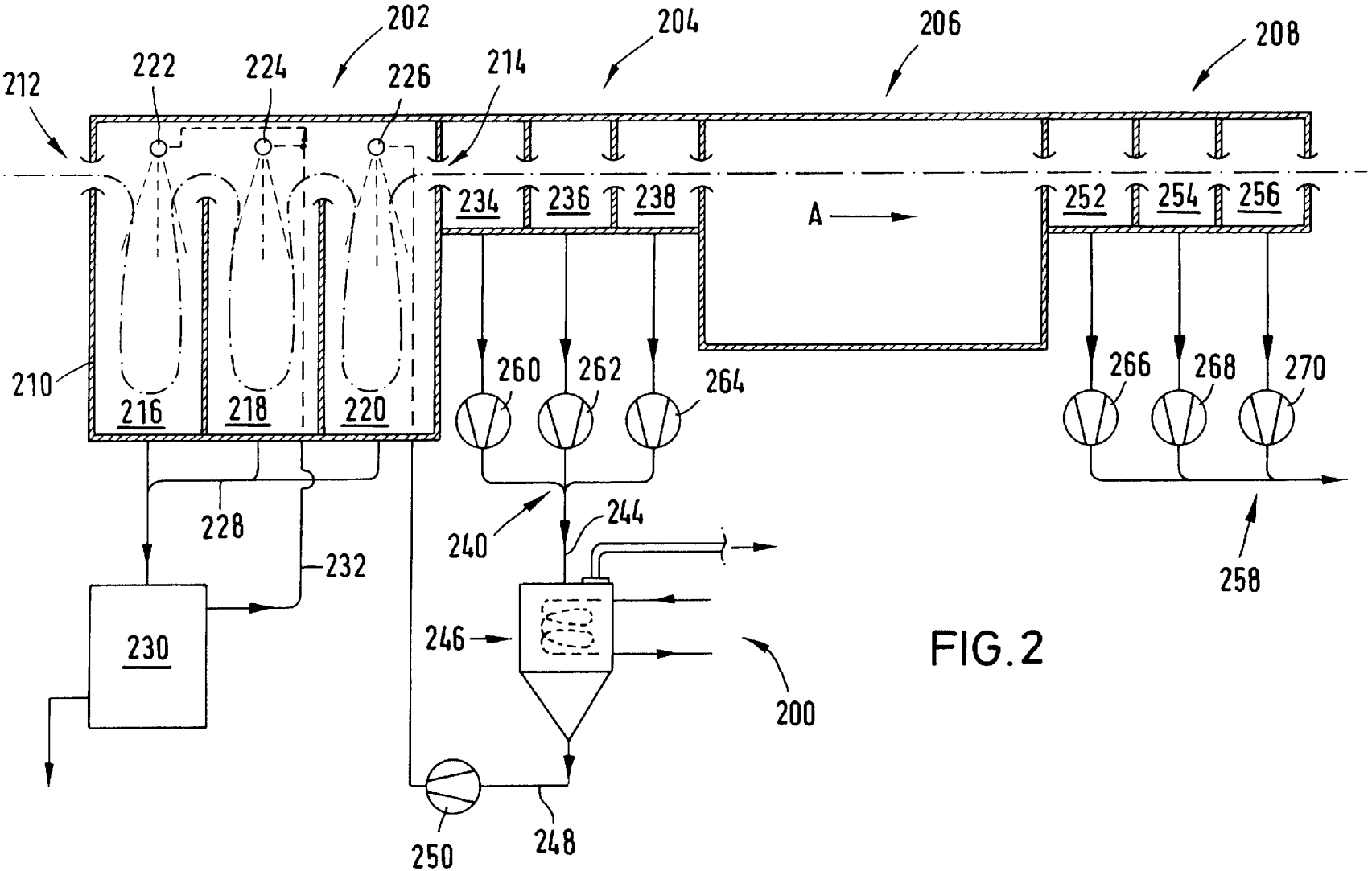
FIG. 2 shows a second embodiment of a device for the treatment of fibrous material.

The device 200 for treating fibrous material according to a second embodiment shown in FIG. 2 is different from the device 100 according to a first embodiment shown in FIG. 1 only in the design of the vacuum drier 204 and the material outlet lock 208. Device parts of the device 200 according to the second embodiment which correspond to device parts of the device 100 according to the first embodiment are therefore provided with reference numerals increased by 100 compared to those of the first embodiment. It is therefore referred to the description of these parts in the context of the first embodiment.

The vacuum drier 204 of the device 200 according to the second embodiment comprises three vacuum pumps 260, 262,264 each being individually associated with the first, second and third vacuum chambers 234,236,238, respectively and producing a vacuum individually adjustable in the individual vacuum chambers 234,236,238. True, the amount of equipment required because of the three first vacuum pumps is higher than that required because of a shared vacuum pump, but this increased amount of equipment has to be contrasted to an easier adjustability of the process management.

Furthermore, the material lock 208 in the device 200 according to the second embodiment comprises further vacuum pumps 266,268,270 individually associated with a material outlet chamber 252,254,256. As separate vacuum pumps 266,268,270 are provided for the material outlet lock, the flow of gas exhausted by these pumps can be treated separately from the flow of gas exhausted by the vacuum pumps 260,262,264. Thereby, the treatment of gases exhausted from the plasma treatment vessel 206 on the one hand and fluid and volatile components exhausted in the vacuum drier 204 on the other hand is simplified. Preferably, the first vacuum pumps 260,262,264 and the further vacuum pumps 266,268,270 are set such that the plasma treatment vessel 206 is evacuated via the further vacuum pumps 266,268,270.

I claim:

1. A device for treating fibrous material, especially sliver, textiles, non-woven fabrics and wool fiber bunches as the fibrous material moves along a substantially continuous path of travel comprising a cleaning chamber (102; 202) for cleaning the fibrous material utilizing a solvent, a vacuum drier chamber (104; 204) downstream of said cleaning chamber, a plasma treatment chamber (106; 206) immediately downstream of said vacuum drier chamber, a vacuum pump (142) for creating a strong vacuum in said vacuum drier chamber (104; 204) for drying the fibrous material as it moves therethrough; a condenser (146; 246) for separating fluid from the flow of gas exhausted from the vacuum drier chamber (104, 204) by said vacuum pump (142), said vacuum drier chamber (104; 204) including a plurality of side-by-side vacuum chambers (134, 136, 138; 234, 236, 238), means for increasing the vacuum in each downstream vacuum chamber as compared to its most immediate upstream vacuum chamber thereby effecting Progressively increasing vacuum from a most downstream vacuum chamber to said plasma treatment chamber (106; 206), said condenser (146, 246) having an outlet for discharging separated fluid, and a pump (150) and a supply conduit (148) for conducting the separated fluid from the condenser outlet to the cleaning vessel (102, 202).

2. A device according to claim 1, wherein the cleaning chamber (102; 202) comprises immersion basins (116, 118, 120; 216, 218, 220) for a wet cleaning operation.

3. A device according to claim 1, wherein the vacuum drier chamber (104;204) is connected to the cleaning vessel (102;202), directly or via a pressure resistant conduit.

4. A device according to claim 1, wherein the plasma treatment vessel (106;206) is connected to the vacuum drier (104;204), directly or via a pressure resistant conduit.

5. A device according to claim 2, wherein the condenser (146;246) is provided in the manner of a stripping column.

6. A device according to claim 1, wherein the cleaning agent is led in the cleaning chamber (102; 202) in counter-flow direction to the travel direction of the fibrous material.

7. A device according to claim 1, wherein a cleaning agent treatment device (130;230) is connected to the cleaning chamber (102;202) to treat and reuse cleaning agent.

8. A device according to claim 1, wherein guiding means and material locks (112,114,108;212,214,208) are provided for the transport of fibrous material in the shape of strands.

9. A device according to claim 1, wherein the vacuum drier (104;204) is provided as a material inlet lock for the plasma treatment vessel (106;206).

10. A device according to claim 1, wherein the plasma treatment chamber (106; 206) comprises a material outlet lock (108, 208) having multiple chambers (152, 154, 156; 252, 254, 256) connected to vacuum pumps (142; 266, 268, 270) and arranged to produce a vacuum in the multiple chambers (152, 154, 156; 252, 254, 256) which vacuum increases in a downstream direction along the path of travel towards the plasma treatment vessel (106; 206).

11. A device according to claim 1, wherein the cleaning vessel (102; 202) comprises immersion basins (116, 118, 120; 216, 218, 220) for a wet cleaning operation and nozzles (122, 124, 126; 222, 224, 226) for a spray cleaning operation.

* * * * *